US010761556B2

(12) United States Patent
Liang et al.

(10) Patent No.: US 10,761,556 B2
(45) Date of Patent: Sep. 1, 2020

(54) ROTATIONAL POSITIONING MECHANISM AND CARRIER

(71) Applicant: Wistron Corporation, New Taipei (TW)

(72) Inventors: Chen-Yi Liang, New Taipei (TW); Cheng-Hsing Liu, New Taipei (TW); Tseng-Hun Yu, New Taipei (TW)

(73) Assignee: Winstron Corporation, New Taipei (TW)

( * ) Notice: Subject to any disclaimer, the term of this patent is extended or adjusted under 35 U.S.C. 154(b) by 320 days.

(21) Appl. No.: 15/942,447

(22) Filed: Mar. 31, 2018

(65) Prior Publication Data

US 2019/0212765 A1 Jul. 11, 2019

(30) Foreign Application Priority Data

Jan. 5, 2018 (TW) ..... 107100583 A

(51) Int. Cl.
*G05G 5/06* (2006.01)
*A61H 3/04* (2006.01)
(Continued)

(52) U.S. Cl.
CPC ..... *G05G 5/06* (2013.01); *A61H 3/04* (2013.01); *G05G 5/02* (2013.01); *A61G 5/10* (2013.01); *G05G 2505/00* (2013.01)

(58) Field of Classification Search
CPC ..... G05G 5/005; G05G 5/02; G05G 5/04; G05G 5/06; G05G 5/065; G05G 2505/00;
(Continued)

(56) References Cited

U.S. PATENT DOCUMENTS 2,633,777 A * 4/1953 Hoern ..... B23Q 16/04 188/69
4,026,048 A * 5/1977 Hill ..... E02F 9/2004 37/234
(Continued)

FOREIGN PATENT DOCUMENTS

CN 202223456 5/2012
CN 106975808 7/2017
(Continued)

OTHER PUBLICATIONS

"Office Action of China Counterpart Application", dated Jun. 12, 2020, p. 1-p. 10.

*Primary Examiner* — Richard W Ridley
*Assistant Examiner* — Brian J McGovern
(74) *Attorney, Agent, or Firm* — JCIPRNET

(57) ABSTRACT

A rotational positioning mechanism includes a base, a rotational shaft, a rotational plate, at least two first switches and a positioning assembly. The rotational shaft is pivoted to the base. The rotational plate is connected to the rotational shaft and is configured to rotate relative to the base along with the rotational shaft. The rotational plate has at least two first positioning portions. The two first switches are respectively disposed at the two first positioning portions. The positioning assembly is disposed at the base, and comprises a positioning component configured to form a structural interference with any one of the first positioning portions or remove the structural interference. After the positioning component forms the structural interference with any one of the first positioning portions, the positioning component abuts against the corresponding first switch, and the degree of rotational freedom of the rotational plate and the rotational shaft are restricted.

24 Claims, 16 Drawing Sheets

(51) Int. Cl.
*G05G 5/02* (2006.01)
*A61G 5/10* (2006.01)

(58) Field of Classification Search
CPC .... B23Q 16/02; B23Q 16/021; B23Q 16/022; B23Q 16/04; B23Q 16/08; B23Q 16/06; B23Q 16/10
See application file for complete search history.

(56) References Cited

U.S. PATENT DOCUMENTS

| | | | | |
|---|---|---|---|---|
| 10,584,767 | B1 * | 3/2020 | Vincent | G05G 5/065 |
| 2011/0220060 | A1 * | 9/2011 | Hausler | G05G 1/04 123/319 |
| 2016/0245396 | A1 * | 8/2016 | Behounek | F16H 61/24 |

FOREIGN PATENT DOCUMENTS

| | | | | |
|---|---|---|---|---|
| GB | 1484398 | A * | 9/1977 | B23Q 16/04 |
| TW | M251586 | | 12/2004 | |
| TW | M336035 | | 7/2008 | |
| TW | M338650 | | 8/2008 | |
| WO | WO-2017055898 | A1 * | 4/2017 | F16H 61/22 |

* cited by examiner

ROTATIONAL POSITIONING MECHANISM AND CARRIER

CROSS-REFERENCE TO RELATED APPLICATION

This application claims the priority benefit of Taiwan application serial no. 107100583, filed on Jan. 5, 2018. The entirety of the above-mentioned patent application is hereby incorporated by reference herein and made a part of this specification.

BACKGROUND

Field of the Disclosure

The disclosure is related to a rotational positioning mechanism and a carrier, and particularly to a rotational positioning mechanism and a carrier utilizing the rotational positioning mechanism.

Description of Related Art

To meet the need for rehabilitation and medical care, currently available wheelchairs or walking aid devices are used to aid people who have difficulties in walking or those undertaking rehabilitation after surgeries or illness. The commonly seen wheelchairs are mainly provided for users to sit thereon and driven to travel in an electrical or a manual manner. The commonly seen walking aid devices mainly function in allowing the users to hold a handle thereof by hands, such that the user can be supported during the travelling process to push the walking aid device to travel, thereby reducing the burden of walking.

Currently carriers which are integrated with functions of wheelchair and walking aid device has been proposed, and the users can switch functions depending on individual's need. Furthermore, in the process of switching functions (i.e., sitting function and walking aid function) of the carrier, the status of the carrier is changed accordingly, for example, the bracket of the carrier is rotated relative to the body of the carrier, and the bracket is locked after being rotated to a position. However, the lock between the bracket and the body is generally completed manually, which may cause the problem of lack of reliability.

SUMMARY

The disclosure provides a rotational positioning mechanism and a carrier utilizing the rotational positioning mechanism, which have good reliability.

In the disclosure, a rotational positioning mechanism includes a base, a rotational shaft, a rotational plate, at least two first switches and a positioning assembly. The rotational shaft is pivoted to the base. The rotational plate is connected to the rotational shaft, and configured to rotate relative to the base along with the rotational shaft. The rotational plate has at least two first positioning portions. The two first switches are respectively disposed at the two first positioning portions. The positioning assembly is disposed at the base. The positioning assembly includes a positioning component configured to form structural interference with any one of the first positioning portions or remove the structural interference. After the positioning component forms the structural interference with any one of the first positioning portions, the positioning component abuts against the corresponding first switch, and the degree of rotating freedom of the rotational plate and the rotational shaft are restricted.

In an embodiment of the disclosure, the base includes at least one side wall portion, and the side wall portion has an assembly hole and a slot disposed in parallel. The positioning assembly and the rotational plate are respectively disposed at two opposite sides of the side wall portion. The rotational plate has an installing end portion penetrating through the side wall portion from the assembly hole for connecting the rotational plate. The positioning component has a second positioning portion which penetrates through the side wall portion from the slot. The second positioning portion is configured to form structural interference with any one of the first positioning portions or remove the structural interference.

In an embodiment of the disclosure, the rotational positioning mechanism further includes a second switch disposed in the slot. When the second positioning portion is moved away from one of the first positioning portions to remove the structural interference, the second positioning portion is separated from the first switch disposed at one of the first positioning portions and triggers the second switch to activate the rotational shaft to drive the rotational plate to rotate relative to the base. When the rotational plate is rotated relative to the base such that another first positioning portion is aligned with the second positioning portion, the second positioning portion is moved close to said another first positioning portion to form structural interference, and the second positioning portion is separated from the second switch and triggers the first switch disposed at said another first positioning portion to stop the rotational shaft from driving the rotational plate to rotate relative to the base.

In an embodiment of the disclosure, the positioning assembly further includes a carriage and a driver, wherein the carriage is fixed to the side wall portion and the driver is fixed to the carriage. The positioning component is pivoted to the carriage, and the driver is configured to drive the positioning component to rotate relative to the carriage such that the second positioning portion is moved in the slot to form structural interference with any one of the first positioning portions or remove the structural interference.

In an embodiment of the disclosure, the positioning assembly further includes an elastic component, and two opposite end portions of the elastic component are respectively connected to the carriage and the positioning component. In the process that the second positioning portion is moved away from one of the first positioning portions to remove the structural interference, the positioning component is driven by the driver to rotate relative to the carriage such that the second positioning portion is moved away from one of the first positioning portions and the elastic component is elastically deformed. After the rotational plate is rotated relative to the base such that said another first positioning portion is aligned with the second positioning portion, the elastic restoring force of the elastic component drives the positioning component to rotate relative to the carriage such that the second positioning portion is moved close to said another first positioning portion and forms the structural interference.

In an embodiment of the disclosure, the positioning assembly further includes a driving component coupled to the driver. The driving component is configured to be driven by the driver to push the positioning component to rotate relative to the carriage and separate from the positioning component.

In an embodiment of the disclosure, the rotational positioning mechanism further includes a side switch disposed at the side wall portion. The rotational plate has at least one triggering portion facing the side wall portion and disposed as corresponding to the side switch. In the process that the rotational plate is rotated relative to the base such that any one of the first positioning portions is aligned with the second positioning portion, the triggering portion triggers the side switch to activate the driver to drive the driving component to rotate relative to the carriage and separate from the positioning component.

In an embodiment of the disclosure, the driver is an electromagnetic valve, and the positioning assembly further includes a driving component. The driving component is coupled to the electromagnetic valve, and the driving component is connected to the positioning component. The driving component is configured to be driven by the electromagnetic valve to move back and forth and drive the positioning component to rotate relative to the carriage.

In an embodiment of the disclosure, the driver is a motor.

In an embodiment of the disclosure, the positioning assembly further includes a driver, and the positioning component is coupled to the driver. The driver is configured to drive the positioning component to move back and forth relative to the side wall portion such that the second positioning portion penetrates through the side wall portion from the slot to form structural interference with any one of the first positioning portions, or such that the second positioning portion is moved back into the slot to remove the structural interference with any one of the first positioning portions.

In an embodiment of the disclosure, the driver is an electromagnetic valve.

In an embodiment of the disclosure, the driver is a motor. The positioning assembly further includes a carriage, a first guiding component and a second guiding component, and the first guiding component and the second guiding component are disposed between the carriage and the side wall portion. The motor is fixed to the carriage. The first guiding component is coupled to the motor and sleeved on the positioning component. The second guiding component is fixed to the carriage and sleeved on the positioning component. The first guiding component is configured to be driven by the motor to rotate and drive the positioning component to be guided by the second guiding component to move back and forth.

In the disclosure, a carrier includes a driven component and a rotational positioning mechanism, wherein the rotational positioning mechanism includes a base, a rotational shaft, a rotational plate, at least two switches and a positioning assembly. The rotational shaft is pivoted to the base. The rotational plate is connected to the rotational shaft and configured to rotate relative to the base along with the rotational shaft. The rotational plate has at least two positioning portions. The driven component is connected to the rotational plate and configured to rotate relative to the base along with the rotational plate and the rotational shaft. The two switches are respectively disposed at the two positioning portions. The positioning assembly is disposed at the base. The positioning assembly includes a positioning component configured to form structural interference with any one of the positioning portions or remove the structural interference. After the positioning component forms the structural interference with any one of the positioning portions, the positioning component abuts against the corresponding switch, and the degree of rotating freedom of the rotational plate and the rotational shaft are restricted.

In summary of the above, in the rotational positioning mechanism of the disclosure, the rotational plate can be rotated automatically relative to the base along with the rotational shaft. Meanwhile, after the rotational plate is rotated to a position, based on the setting of the triggering mechanism, the rotational shaft stops rotating. Also, the positioning component of the positioning assembly form the structural interference with the rotational plate such that the status of the rotational plate is locked. After the status of the rotational plate is locked, even if the rotational plate is subjected to an external force, the rotational plate is not easily rotated relative to the base. Therefore, both of the rotational positioning mechanism and the carrier utilizing the rotational positioning mechanism in the disclosure have good reliability.

In order to make the aforementioned features and advantages of the disclosure more comprehensible, embodiments accompanying figures are described in detail below.

DESCRIPTION OF EMBODIMENTS

Figure 1A:
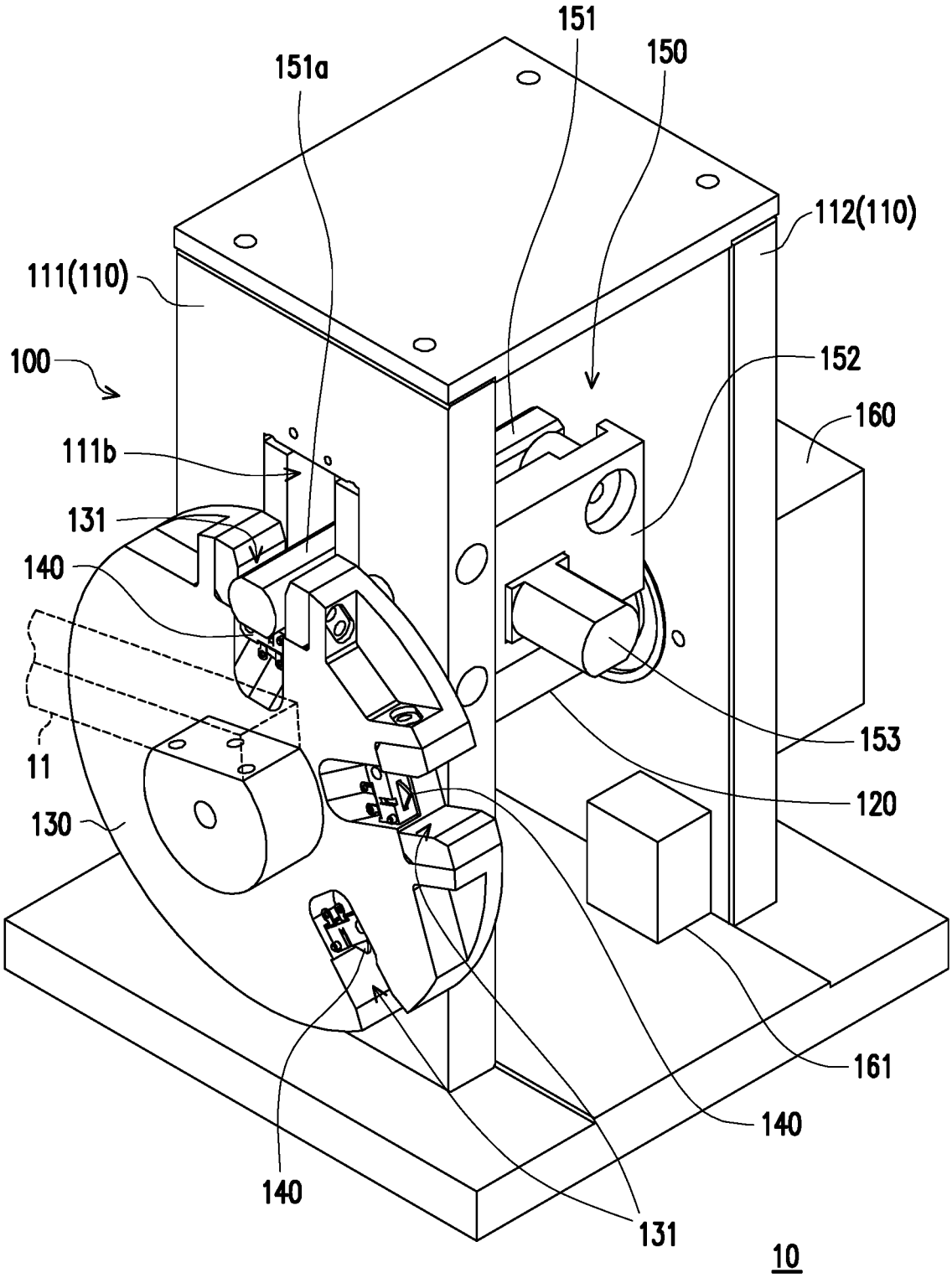
FIG. 1A and FIG. 1B are respective schematic structural views illustrating a carrier at two different viewing angles according to a first embodiment of the disclosure, and the carrier is in a first status.
Figure 1B:
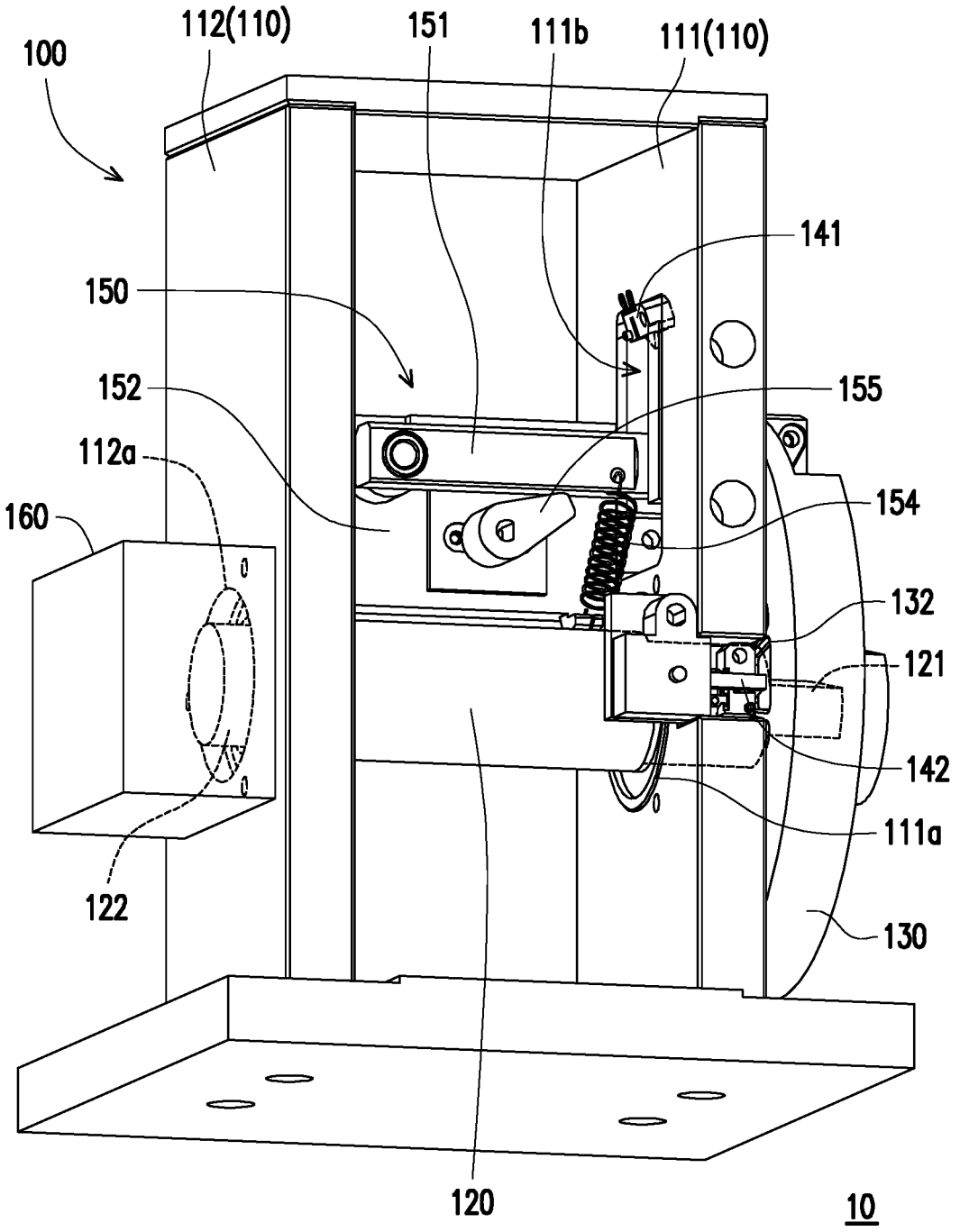

FIG. 1A and FIG. 1B are respective schematic structural views illustrating a carrier at two different viewing angles according to a first embodiment of the disclosure, and the carrier is in a first status. Referring to FIG. 1A and FIG. 1B, in the embodiment, a carrier 10 includes a driven component 11 and a rotational positioning mechanism 100. Based on the rotational positioning mechanism provided by the rotational positioning mechanism 100, the driven component 11 may be rotated or locked along with the mechanism. For example, the carrier 10 may be a wheelchair, a walking aid device, an unmanned car, or a portion of an automatic configuration, which should not be construed as a limitation to the disclosure. It should be indicated that the driven component 11 is shown in FIG. 1A for exemplary purpose but omitted in the other drawings.

The rotational positioning mechanism 100 includes a base 110, a rotational shaft 120, a rotational plate 130, at least two first switches 140 and a positioning assembly 150, wherein the base 110 includes a first side wall portion 111 and a second side wall portion 112 opposite to each other. The rotational shaft 120 penetrates through the first side wall portion 111 and the second side wall portion 112, and pivoted to the first side wall portion 111 and the second side wall portion 112. In other words, the rotational shaft 120 may be rotated relative to the base 110. Specifically, the first side wall portion 111 has a first assembly hole 111*a* and a slot 111*b* disposed in parallel, and the second side wall portion 112 has a second assembly hole 112*a* aligned with the first assembly hole 111*a*. An installing end 121 of the rotational shaft 120 penetrates through the first side wall portion 111 from the first assembly hole 111*a*, wherein the rotational plate 130 is fixed to the installing end 121, and the second side wall portion 112 and the rotational plate 130 are respectively disposed at two opposite sides of the first side wall portion 111. On the other hand, a driving end 122 of the rotational shaft 120 penetrates through the second side wall portion 112 from the second assembly hole 112*a* and coupled to the driver 160. The driver 160 may be a motor which drives the rotational shaft 120 to rotate relative to the base 110. Therefore, the rotational plate 130 and the driven component 11 connected to the rotational plate 130 can be rotated relative to the base 110 along with rotational shaft 120.

The rotational plate 130 has at least two first positioning portions 131 disposed along the periphery thereof. In the embodiment, the number of the first switch 140 is equal to the number of the first positioning portion 131, and the drawings show three first switches 140 and three first positioning portions 131 for exemplary purpose, but the disclosure provides no limitation to the number of the first switch 140 and the number of the first positioning portion 131. On the other hand, the first positioning portion 131 may be a positioning recess that is inward from the outer periphery surface of the rotational plate 130 to the center of the rotational plate 130, and each of the positioning recesses (i.e., first positioning portion 131) is provided with a first switch 140 therein.

The positioning assembly 150 is disposed at the first side wall portion 111, wherein the positioning assembly 150 is disposed between the first side wall portion 111 and the second side wall portion 112, and the positioning assembly 150 and the rotational plate 130 are respectively disposed at two opposite sides of the first sidewall portion 111. The positioning assembly 150 includes a positioning component 151, wherein the positioning component 151 is disposed as corresponding to the slot 111*b* and able to move back and forth in the slot 111*b*. A part of the positioning component 151 (i.e., second positioning portion 151*a*) may penetrate through the first side wall portion 111 from the slot 111*b*, in the first status shown in FIG. 1A, the second positioning portion 151*a* of the positioning component 151 is embedded into one of the positioning recesses (i.e., first positioning portion 131) to form structural interference. At this time, the rotational plate 130 and the rotational shaft 120 are restricted by the positioning component 151 and thus unable to be rotated relative to the base 110. In the meantime, the second positioning portion 151*a* embedded into the positioning recess (i.e., first positioning portion 131) abuts against the corresponding first switch 140 and the triggered first switch 140 transmits a first signal to a controller 161, wherein the controller 161 and the driver 160 are electrically coupled to each other, and the controller 161 receiving the first signal controls the driver 160 to stop operating to avoid destroying the second positioning portion 151*a* embedded into the positioning recess (i.e., first positioning portion 131).

In the embodiment, the positioning assembly 150 further includes a carriage 152, a driver 153, an elastic component 154 and a driving component 155, wherein the carriage 152 is fixed to the first side wall portion 111, and the driver 153 is fixed to the carriage 152. The driver 153 may be a motor, wherein the driving component 155 is coupled to the driver 153, and the driving component 155 is configured to be driven by the driver 153 to rotate relative to the carriage 152. On the other hand, the two opposite end portions of the elastic component 154 are respectively connected to the carriage 152 and the positioning component 151, wherein the elastic component 154 may be a tensile spring, and the elastic component 154 shown in FIG. 1B is in the status of not being stretched and deformed, thereby preventing the second positioning portion 151*a* embedded into the positioning recess (i.e., first positioning portion 131) from being moved out of the positioning recess (i.e., first positioning portion 131).

It should be indicated that the driving component 155 in FIG. 1B is in contact with the positioning component 151, wherein a distance from a contact point of the driving component 155 and the positioning component 151 to a pivoting center (i.e., pivoting point of the positioning component 151 and the carriage 152) of the positioning component 151 is larger than a distance from a contact point of the driving component 155 and the positioning component 151 to a pivoting center (i.e., a pivoting point of the driving component 155 and the driver 153) of the driving component 155. Based on the design of moment arm, the driver 153 can drive the driving component 155 to rotate relative to the carriage 152 through a smaller output torsion, and overcome the force applied by the elastic component 154 to the positioning component 151 to push the positioning component 151 to rotate relative to the carriage 152.

Figure 2A:
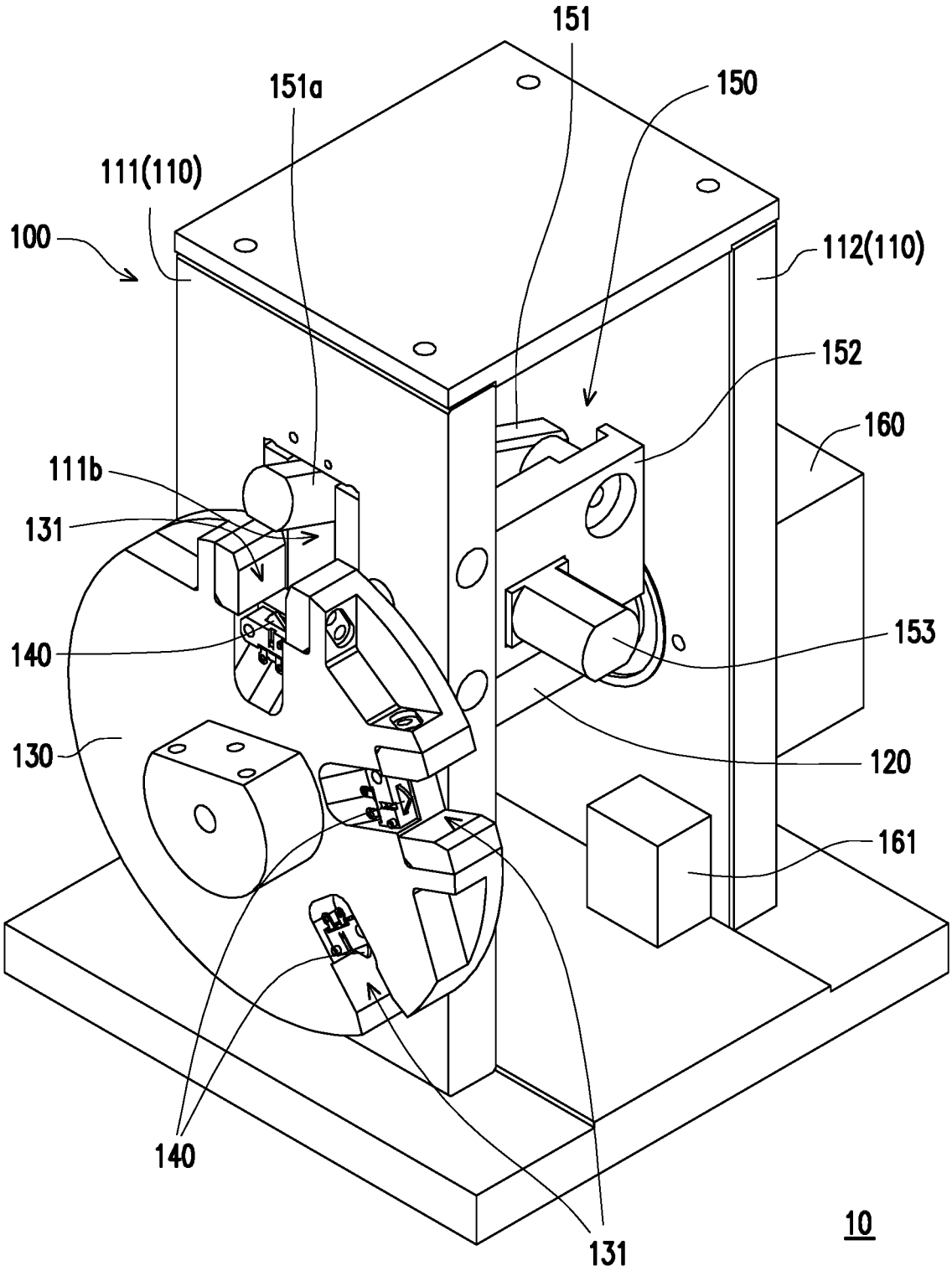
FIG. 2A and FIG. 2B are respective schematic structural views illustrating the carrier at two different viewing angles according to the first embodiment of the disclosure, and the carrier is in a second status.
Figure 2B:
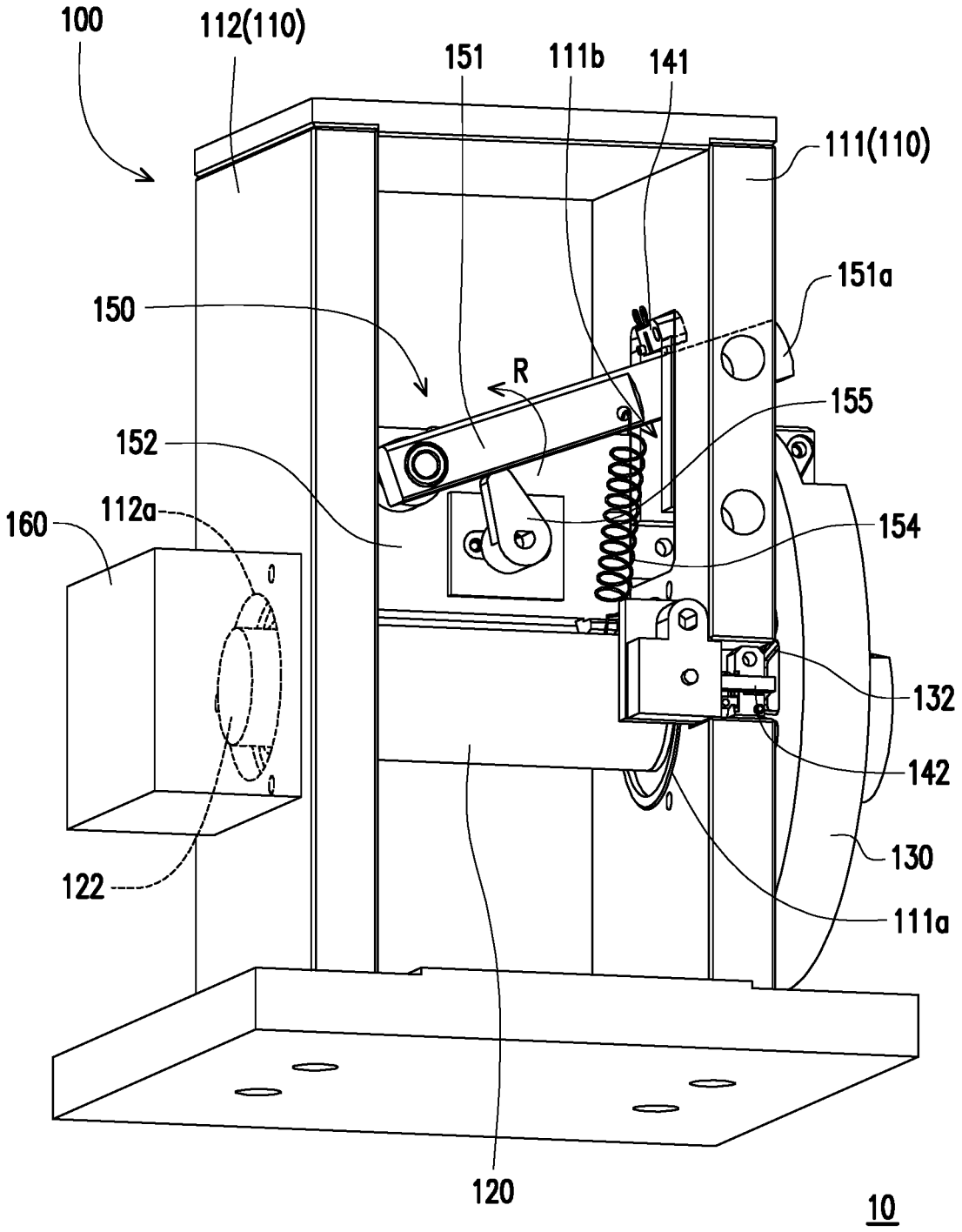

FIG. 2A and FIG. 2B are respective schematic structural views illustrating the carrier at two different viewing angles according to the first embodiment of the disclosure, and the carrier is in a second status. Referring to FIG. 2A and FIG. 2B, in the process that the driver 153 drives the driving component 155 to rotate relative to the carriage 152 along a rotating direction R, and the driving component 155 pushes the positioning component 151 to rotate relative to the carriage 152 along the rotating direction R, the second positioning portion 151*a* of the positioning component 151 is moved away from the positioning recess (i.e., first positioning portion 131). Specifically, after the second positioning portion 151*a* of the positioning component 151 is moved out of the positioning recess (i.e., first positioning portion 131), the structural interference between the second positioning portion 151*a* and the positioning recess (i.e., first positioning portion 131) is removed.

In the embodiment, the rotational positioning mechanism 100 further includes the second switch 141, wherein the second switch 141 is disposed in the slot 111*b*, and for example, installed at an inner wall surface of the slot 111*b* away from the rotational shaft 120. After the second positioning portion 151*a* of the positioning component 151 is moved out of the positioning recess (i.e., first positioning portion 131), the second positioning portion 151*a* is moved toward the inner wall surface of the slot 111*b* away from the rotational shaft 120 and abuts against the second switch 141. The triggered second switch 141 transmits a second signal to the controller 161, wherein the controller 161 and the driver 153 are electrically coupled together, and the controller 161 receiving the second signal controls the driver 153 to stop operating, thereby avoiding destroying the second switch 141 and the second positioning portion 151*a* that abut against each other. On the other hand, the positioning component 151 after rotation causes the elastic component 154 to be stretched and deformed, and is elastically deformed. After the driver 153 stops operating, the driving component 155 is locked in a status shown in FIG. 2B. Since the positioning component 151 vertically abuts against the driving component 155, and the force applied by the positioning component 151 to the driving component 155 passes through the rotational axis of the driving component 155, the positioning component 151 and the elastic component 154 can be maintained in the status shown in FIG. 2B. In other words, the elastic component 154 in such status cannot be elastically restored and drive the positioning component 151 to rotate relative to the base 110 along the opposite direction of the rotating direction R1.

Figure 3A:
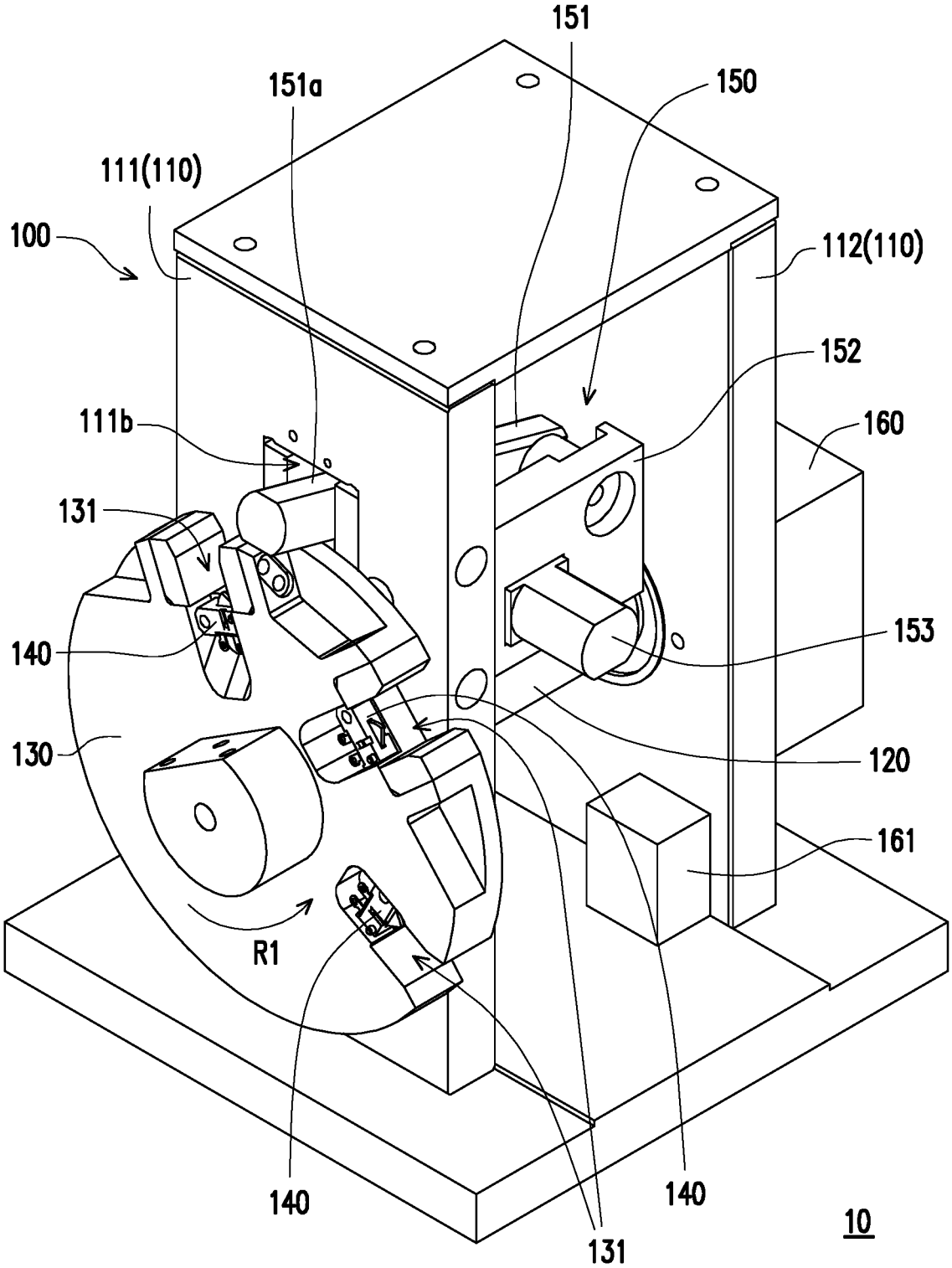
FIG. 3A and FIG. 3B are respective schematic structural views illustrating the carrier at two different viewing angles according to the first embodiment of the disclosure, and the carrier is in a third status.
Figure 3B:
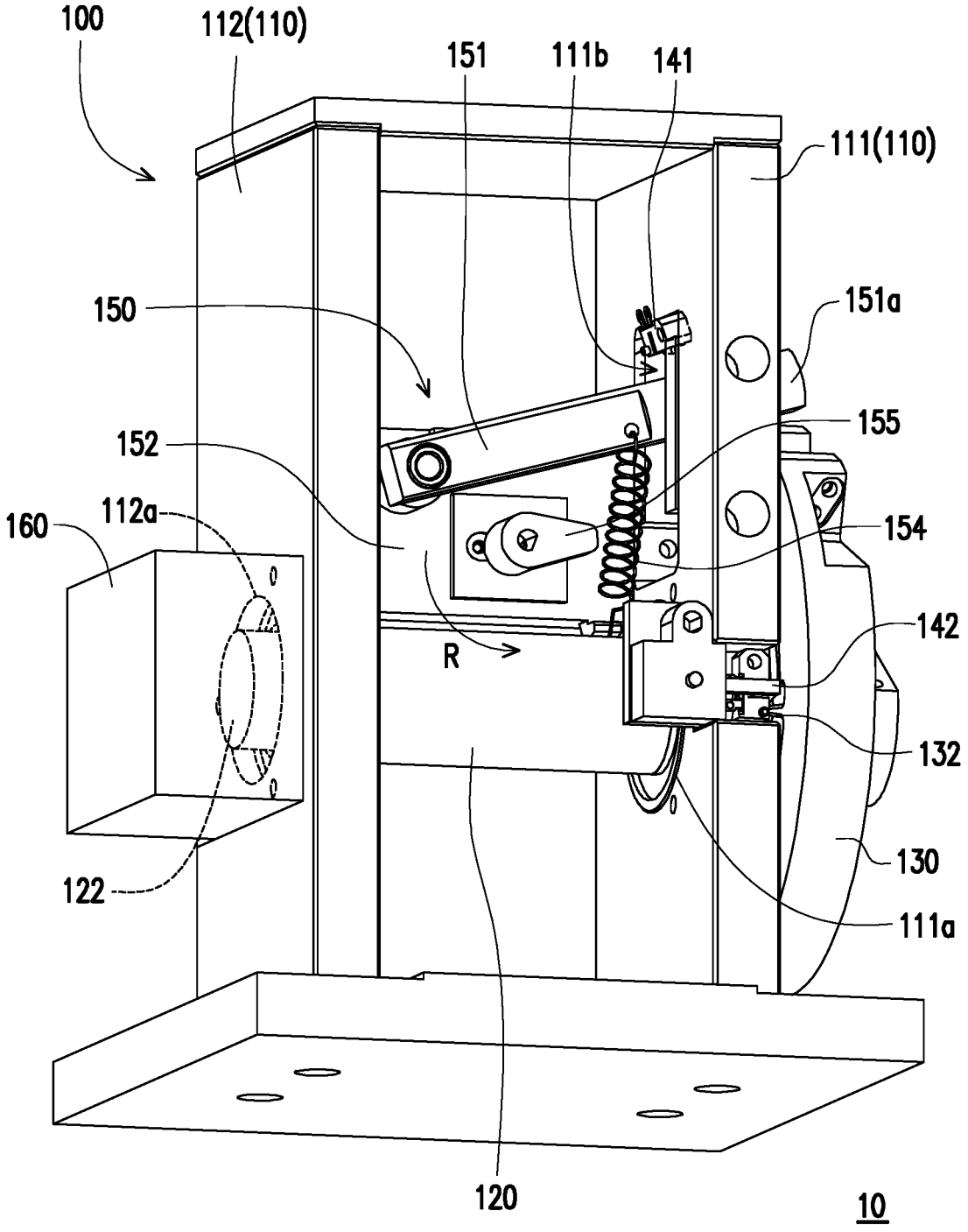

FIG. 3A and FIG. 3B are respective schematic structural views illustrating the carrier at two different viewing angles according to the first embodiment of the disclosure, and the carrier is in a third status. Referring to FIG. 3A and FIG. 3B, in the condition where the controller 161 receives the second signal but not receive the first signal, the controller 161 activates the driver 160 to operate to drive the rotational shaft 120 to rotate. Meanwhile, the rotational shaft 120 drives the rotational plate 130 to rotate relative to the base 110 along the rotational direction R1. In the embodiment, the rotational positioning mechanism 100 further includes a side switch 142 disposed at the first side wall portion 111, and the rotational plate 130 has at least one triggering portion 132 facing the side wall portion 111 and disposed as corresponding to the side switch 142. In the embodiment, the side switch 142 may be a switch button, and other embodiments may adopt a variable resistance; the disclosure is not limited thereto.

In the process that the rotational plate 130 is rotated relative to the base 110 along the rotating direction R1, the trigger portion 132 is moved to pass through the side switch 142 and triggers the side switch 142 as shown in FIG. 2B and FIG. 3B. The triggered side switch 142 transmits a third signal to the controller 161, and the controller 161 receiving the third signal activates the driver 153 to operate to drive the driving component 155 to rotate relative to the carriage 152 along the rotating direction R or the opposite direction thereof to be separated from the positioning component 151. After the support for the driving component 155 is removed, the positioning component 151 is driven by the elastic restoring force of the elastic component 154 to rotate relative to the carriage 152 along the opposite direction of the rotating direction R and abuts against the outer periphery surface of the rotational plate 130 as shown in FIG. 3A. At this time, the second positioning portion 151*a* and the second switch 141 are separated from each other, and the second switch 141 stops transmitting the second signal to the controller 161; the controller 161 that does not receive the second signal controls the driver 153 to stop operating.

Figure 4A:
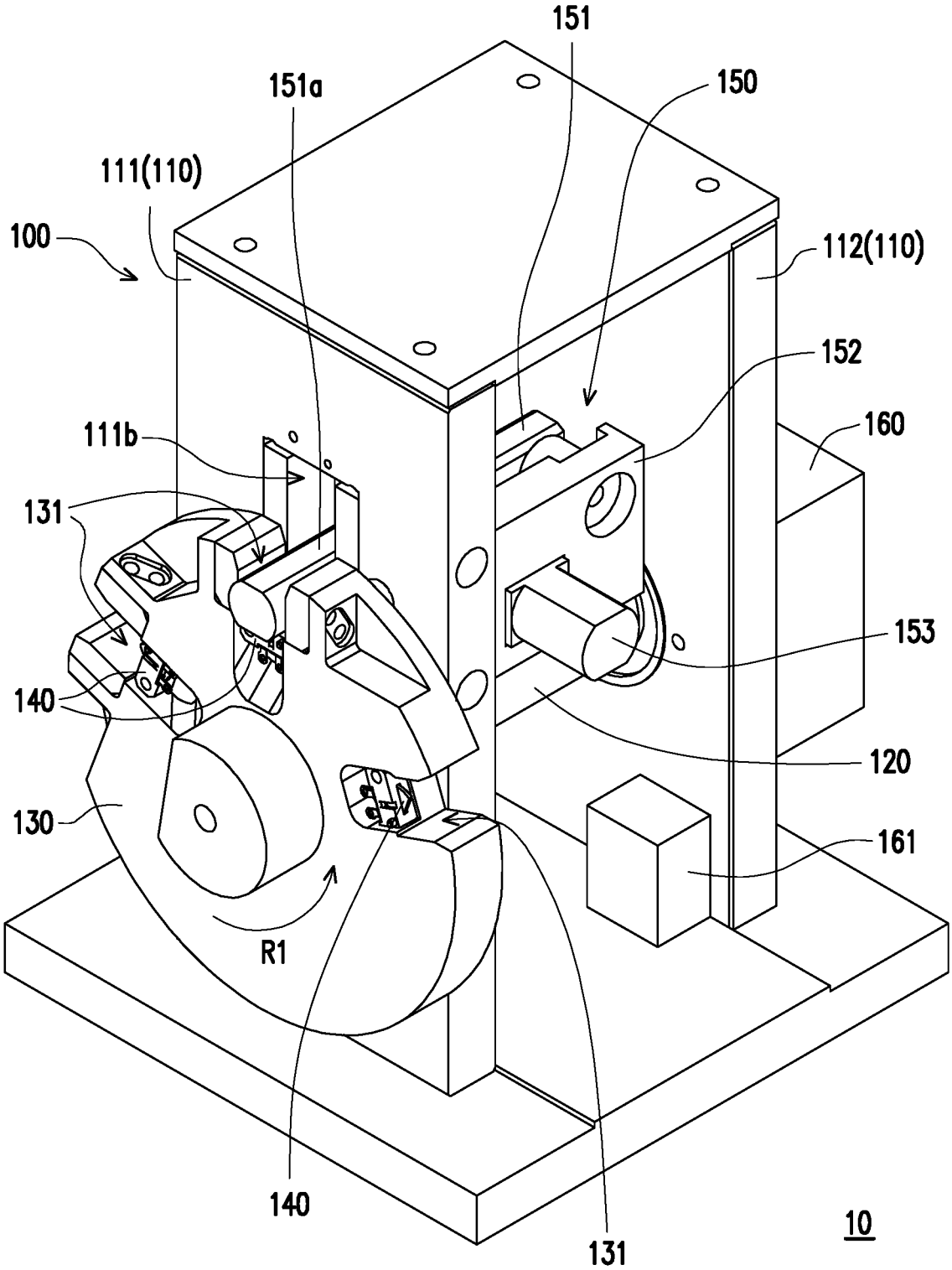
FIG. 4A and FIG. 4B are respective schematic structural views illustrating the carrier at two different viewing angles according to the first embodiment of the disclosure, and the carrier is in a fourth status.
Figure 4B:
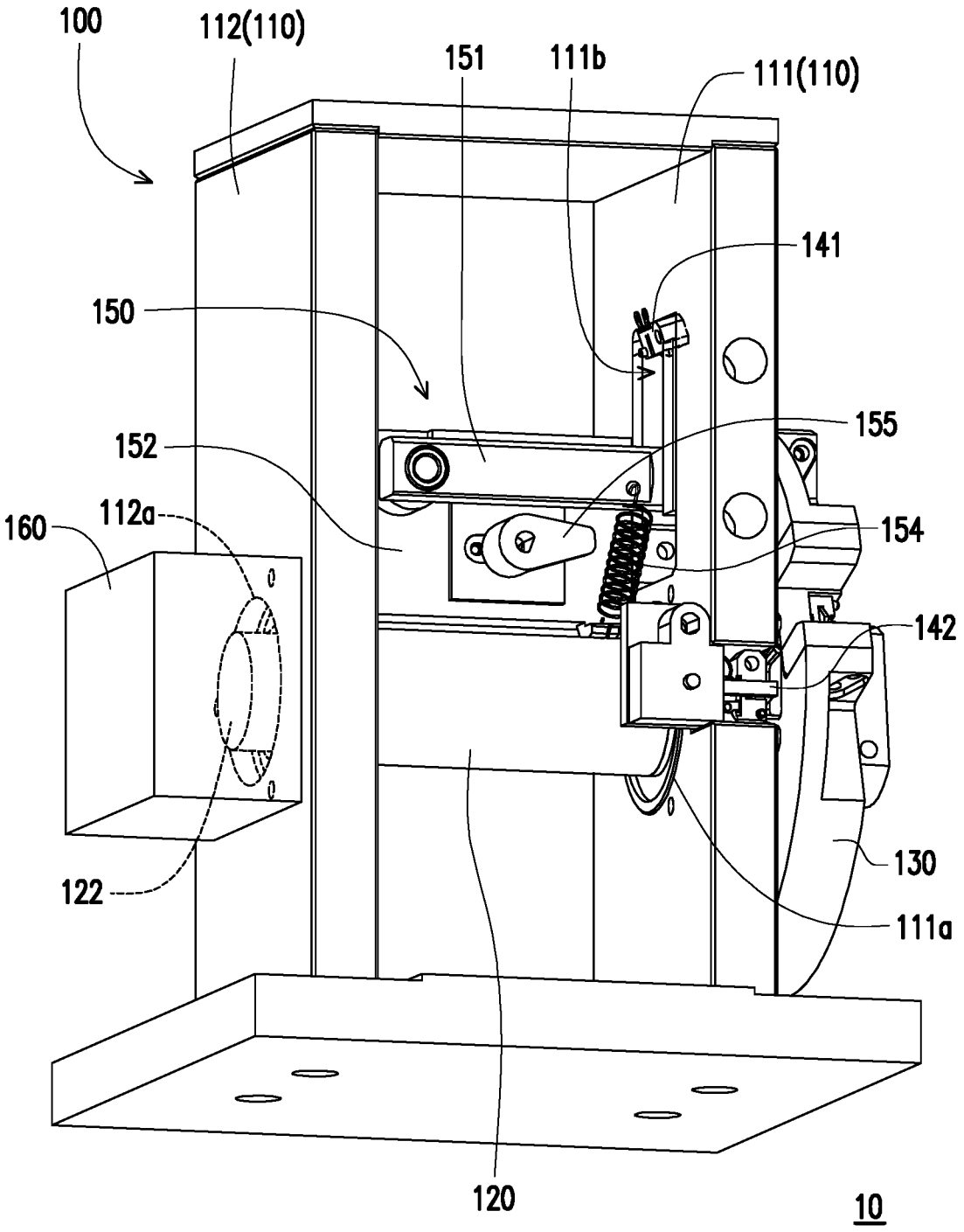

FIG. 4A and FIG. 4B are respective schematic structural views illustrating the carrier at two different viewing angles according to the first embodiment of the disclosure, and the carrier is in a fourth status. Referring to FIG. 4A and FIG. 4B, the rotational plate 130 is continuously rotated relative to the base 110 along the rotating direction R1 until the second positioning portion 151*a* is aligned with the next positioning recess (i.e., first positioning portion 131). After the second positioning portion 151*a* is aligned with the next positioning recess (i.e., first positioning portion 131), the positioning component 151 is driven by the elastic restoring force of the elastic component 154 to rotate relative to the carriage 152 along the opposite direction of the rotating direction R (see FIG. 3B), such that the second positioning portion 151*a* is moved into the next positioning recess (i.e., first positioning portion 131) to form structural interference. Meanwhile, the second positioning portion 151*a* abuts against the corresponding first switch 140, the triggered first switch 140 transmits the first signal to the controller 161, and the controller 161 receiving the first signal controls the driver 160 to stop operating, thereby avoiding destroying the second positioning portion 151*a* embedded into the positioning recess (i.e., first positioning portion 131).

In the embodiment, the positioning component 151 is a solid structure; in other embodiments, the positioning component may be provided with an opening or other structural weakness. In this manner, when the second positioning portion of the positioning component is embedded into the positioning recess (i.e., first positioning portion) of the rotational plate, if an external force forcefully destroys the locking status of the rotational plate, the positioning component subjected to the external force can be destroyed first to avoid causing damage to the rotational plate and other components.

Other embodiments are incorporated below to facilitate understanding of the disclosure. It should be indicated that the reference numeral and some content used in the previous embodiments are incorporated in the following embodiments, wherein the same reference numerals denote the same or similar components, and the same technical content is omitted. The previous embodiments may serve as reference for the omitted descriptions, and thus no repetition is incorporated herein.

Figure 5A:
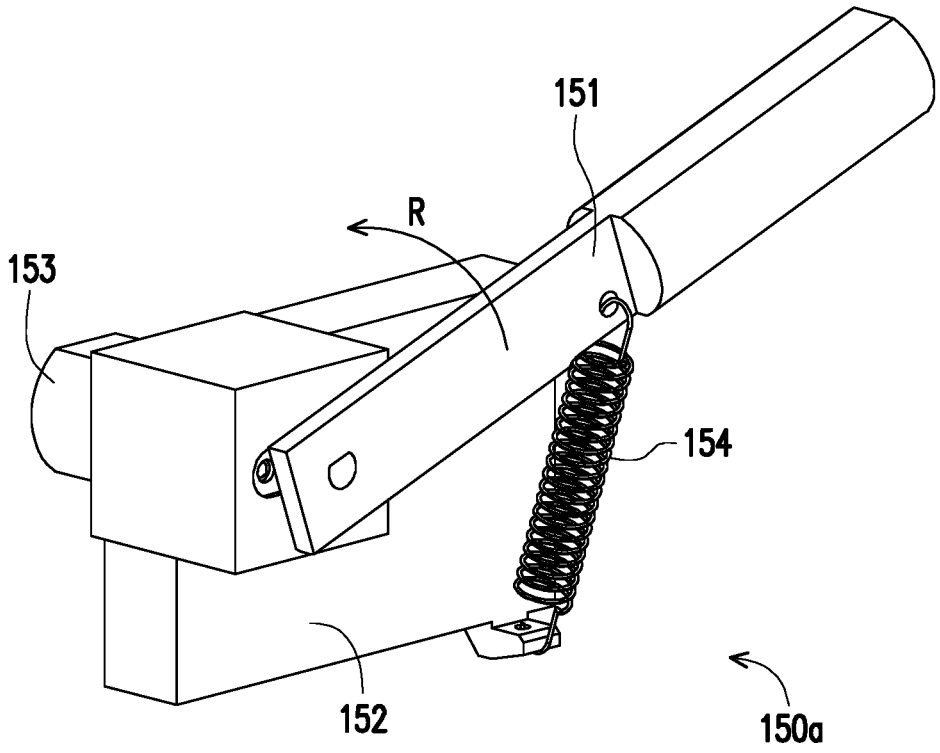
FIG. 5A and FIG. 5B are respective schematic structural views illustrating a positioning assembly in two actuating statuses according to a second embodiment of the disclosure.
Figure 5B:
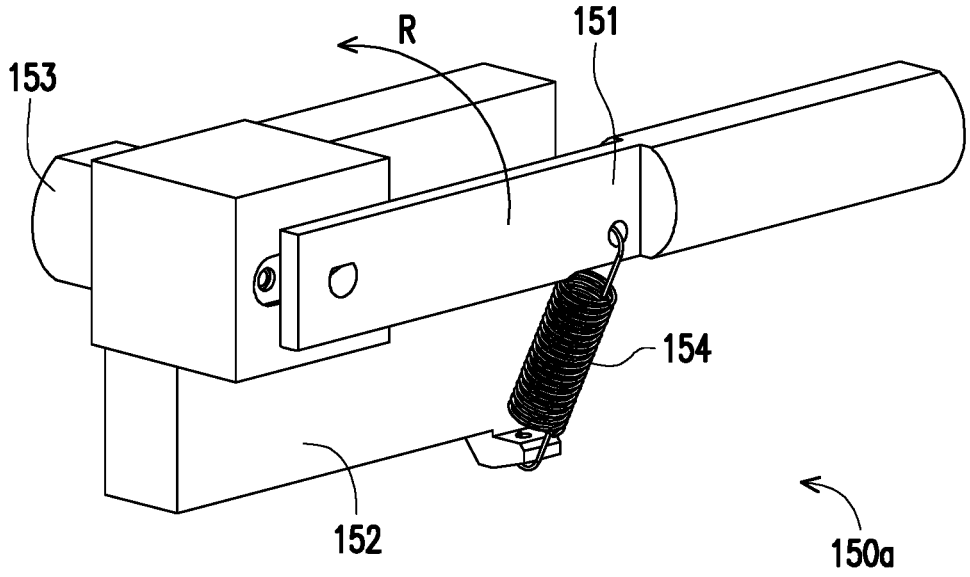

FIG. 5A and FIG. 5B are respective schematic structural views illustrating a positioning assembly in two actuating statuses according to a second embodiment of the disclosure. Referring to FIG. 5A and FIG. 5B, a positioning assembly 150*a* in the embodiment is adaptable for the rotational positioning mechanism 100 in the first embodiment, and the main difference between the positioning assembly 150*a* and the positioning assembly 150 in the first embodiment is that the positioning component 151 of the positioning assembly 150*a* is directly coupled to the driver 153. Moreover, the positioning component 151 may be driven by the driver 153 to rotate relative to the carriage 152 along the rotating direction R. On the other hand, the elastic restoring force of the elastic component 154 can overcome the self-locking force of the driver 153 to drive the positioning component 151 to rotate relative to the carriage 152 along the opposite direction of the rotating direction R.

Figure 6A:
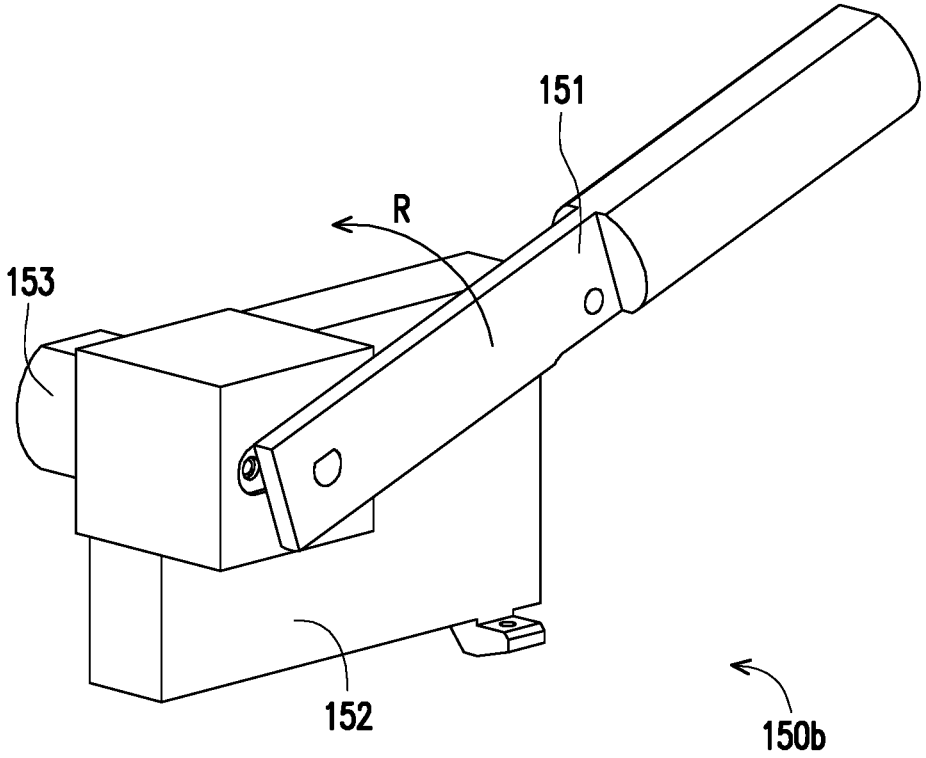
FIG. 6A and FIG. 6B are respective schematic structural views illustrating a positioning assembly in two actuating statuses according to a third embodiment of the disclosure.
Figure 6B:
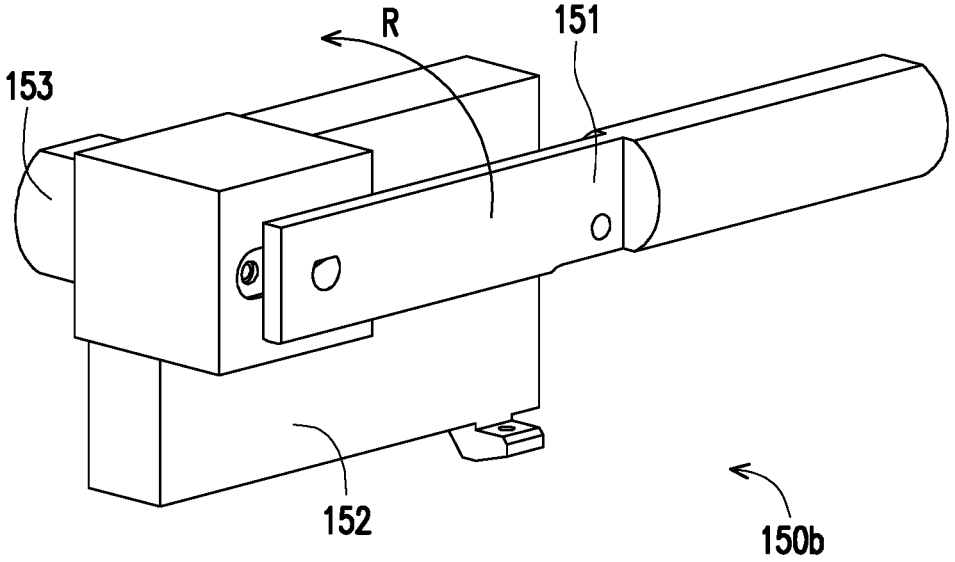

FIG. 6A and FIG. 6B are respective schematic structural views illustrating a positioning assembly in two actuating statuses according to a third embodiment of the disclosure. Referring to FIG. 6A and FIG. 6B, a positioning assembly 150*b* in the embodiment is adaptable for the rotational positioning mechanism 100 in the first embodiment, and the main difference between the positioning assembly 150*b* and the positioning assembly 150 in the first embodiment is that the positioning component 151 of the positioning assembly 150*b* is directly coupled to the driver 153. Moreover, the positioning component 151 may be driven by the driver 153 to rotate relative to the carriage 152 along the rotating direction R or the opposite direction thereof.

Figure 7A:
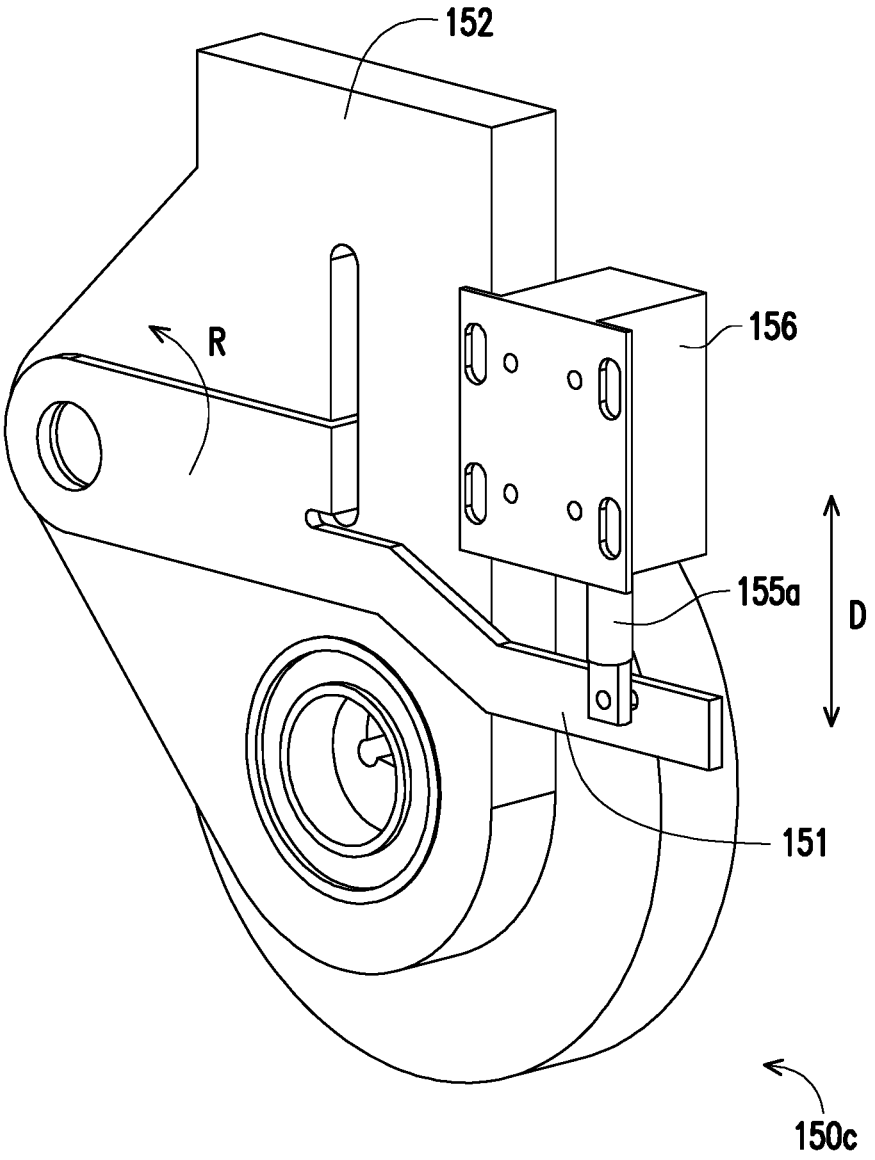
FIG. 7A and FIG. 7B are respective schematic structural views illustrating a positioning assembly in two actuating statuses according to a fourth embodiment of the disclosure.
Figure 7B:
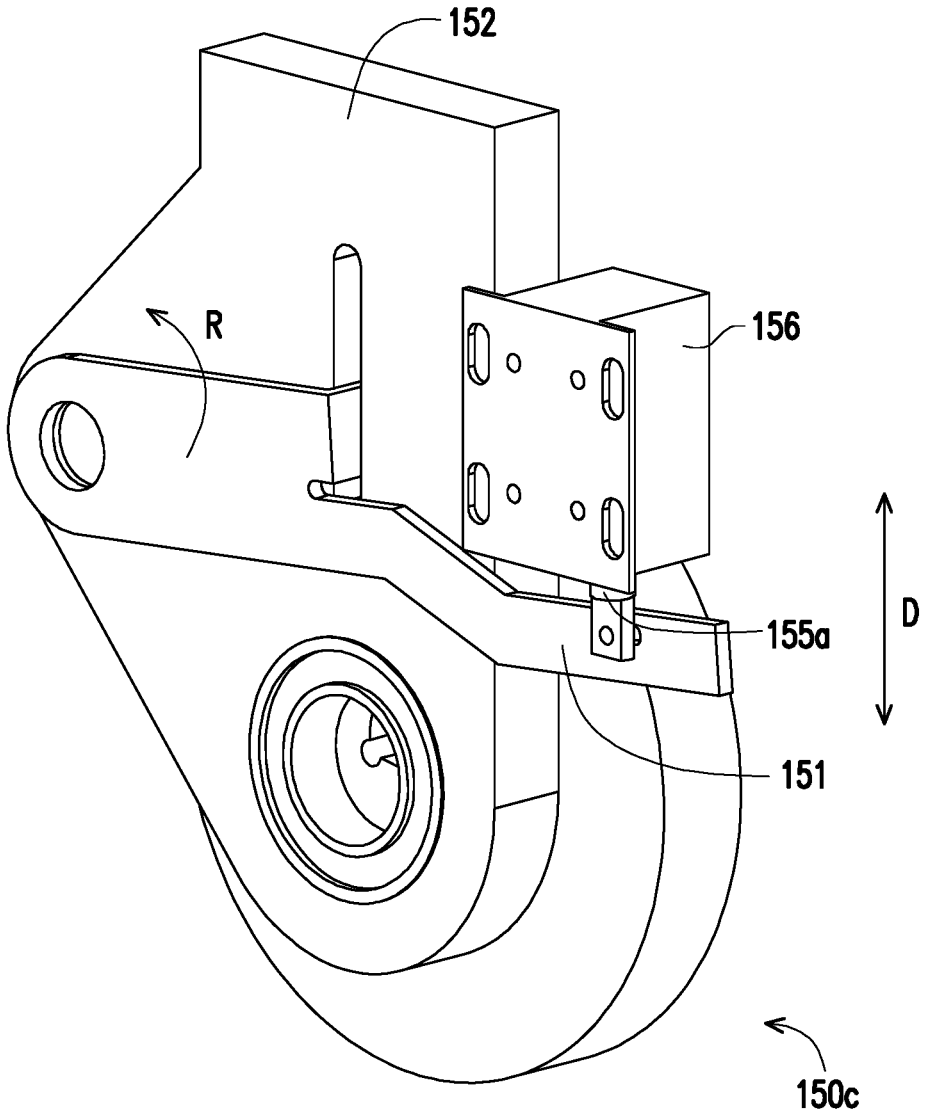

FIG. 7A and FIG. 7B are respective schematic structural views illustrating a positioning assembly in two actuating statuses according to a fourth embodiment of the disclosure. Referring to FIG. 7A and FIG. 7B, a positioning assembly 150*c* in the embodiment is adaptable for the rotational positioning mechanism 100 in the first embodiment, and the main difference between the positioning assembly 150*c* and the positioning assembly 150 in the first embodiment is that the driver of the positioning assembly 150*c* is an electromagnetic valve 156, and a driving component 155*a* is coupled to the electromagnetic valve 156. The driving component 155*a* is connected to the positioning component 151, configured to be driven by the electromagnetic valve 156 to move back and forth along a moving direction D, and drive the positioning component 151 to rotate relative to the carriage 152 along the rotating direction R or the opposite direction thereof.

Figure 8A:
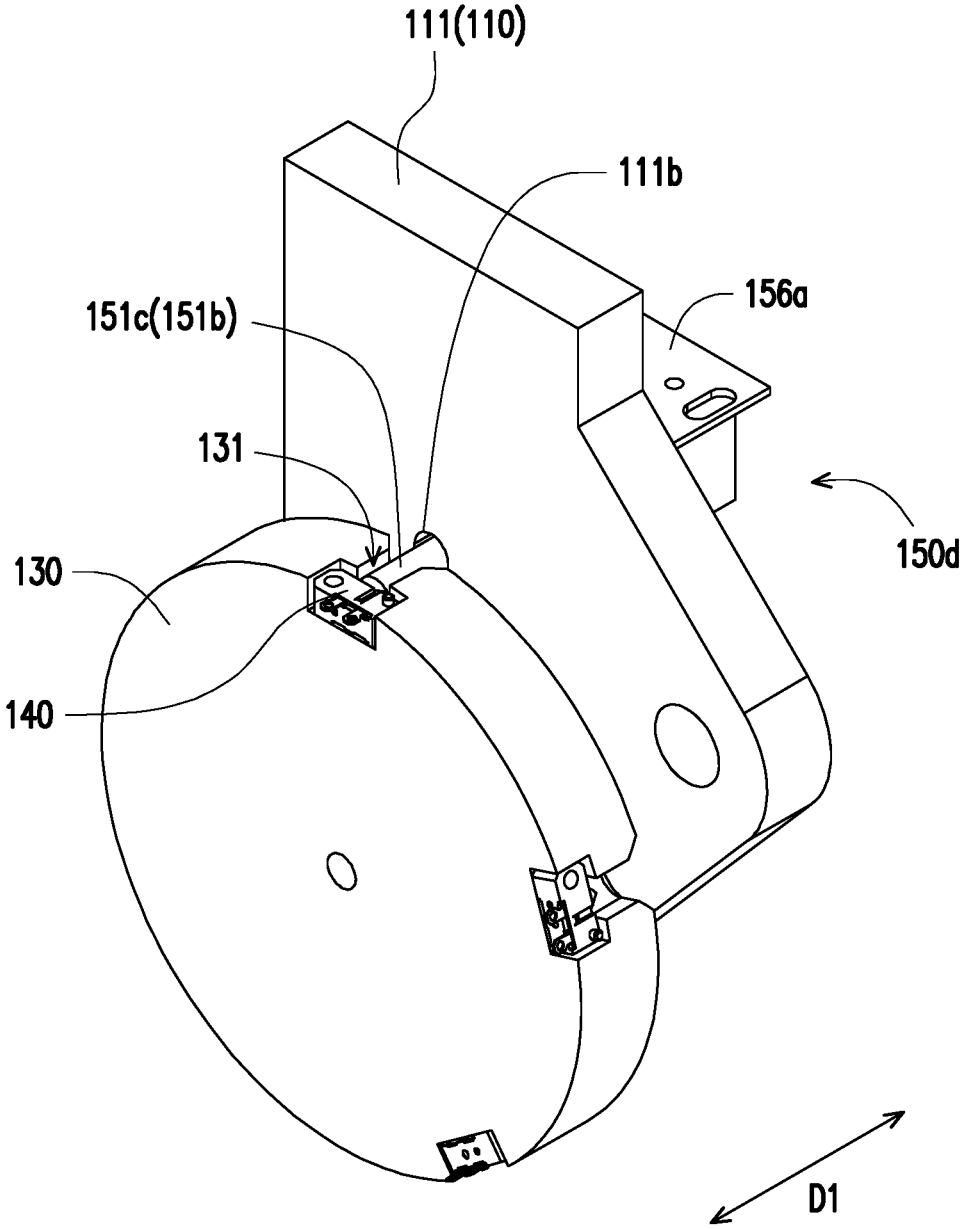
FIG. 8A and FIG. 8B are respective schematic structural views illustrating a positioning assembly in two actuating statuses according to a fifth embodiment of the disclosure.
Figure 8B:
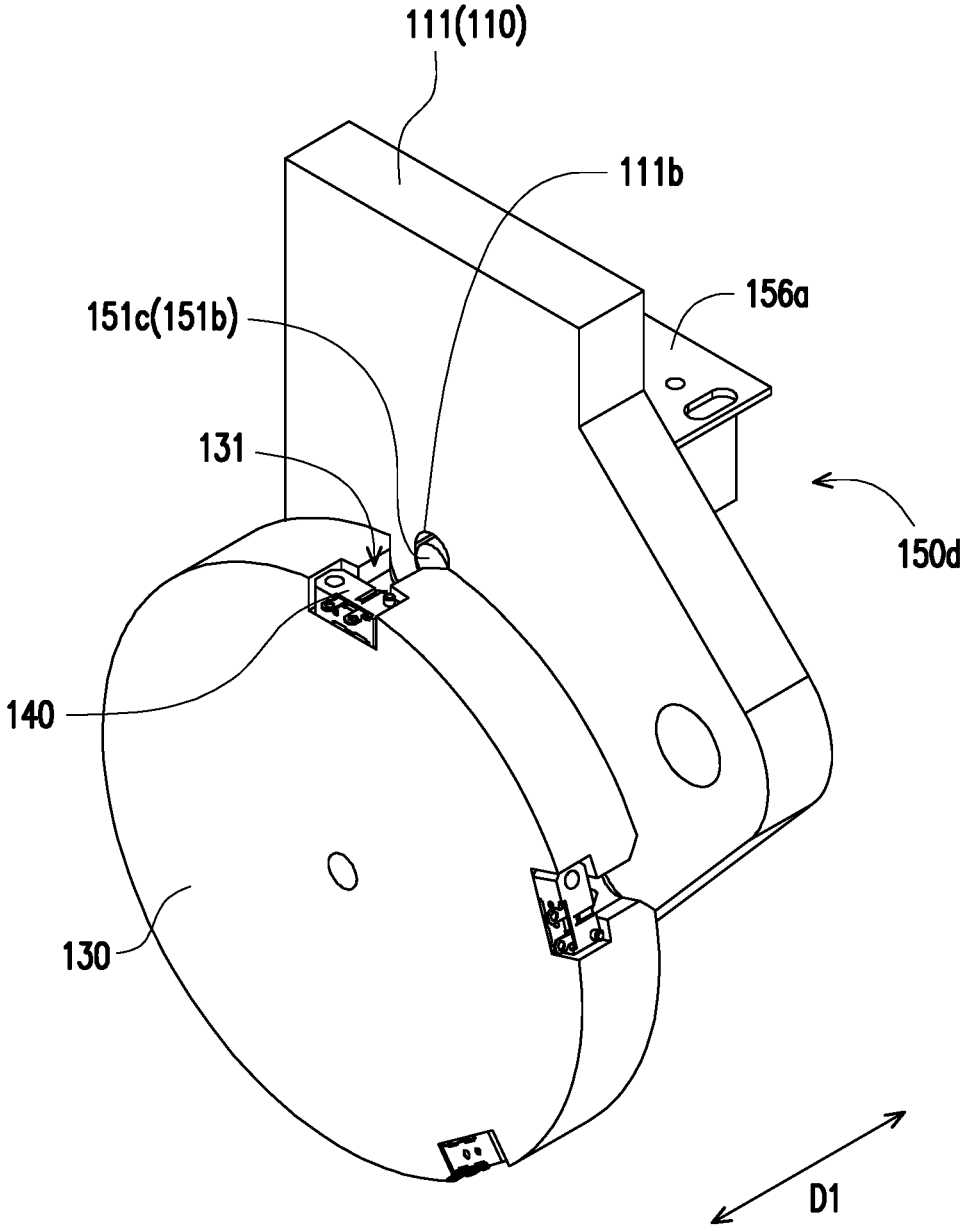

FIG. 8A and FIG. 8B are respective schematic structural views illustrating a positioning assembly in two actuating statuses according to a fifth embodiment of the disclosure. For ease of description, the first side wall portion 111 of the base 110, the rotational plate 130 and the first switch 140 disposed at the first positioning portion 131 are illustrated for exemplary purpose. Referring to FIG. 8A and FIG. 8B, a positioning assembly 150*d* in the embodiment is adaptable for the rotational positioning mechanism 100 in the first embodiment, and the main difference between the positioning assembly 150*d* and the positioning assembly 150 in the first embodiment is that the driver of the positioning assembly 150*d* is an electromagnetic valve 156*a*, wherein the electromagnetic valve 156*a* is fixed to the first side wall portion 111 and disposed as corresponding to the slot 111*b*. The positioning component 151*b* is coupled to the electromagnetic valve 156*a*, wherein the positioning component 151*b* is disposed as corresponding to the slot 111*b*, and the electromagnetic valve 156*a* is configured to drive the positioning component 151*b* to move back and forth relative to the first side wall portion 111 along a moving direction D1, such that the second positioning portion 151*c* of the positioning component 151*b* penetrates through the first side wall portion 111 from the slot 111*b* to form structural interference with the first positioning portion 131 (i.e., positioning recess) of the rotational plate 130, or such that the second positioning portion 151*c* of the positioning component 151*b* is moved back into the slot 111*b* to remove the structural interference.

After the second positioning portion 151*c* of the positioning component 151*b* and the first positioning portion 131 (i.e., positioning recess) of the rotational plate 130 form the structural interference, the second positioning portion 151*c* of the positioning component 151*b* abuts against and triggers the first switch 140. On the contrary, after the second positioning portion 151*c* of the positioning component 151*b* is moved back into the slot 111*b* to remove the structural interference with the first positioning portion 131 (i.e., positioning recess) of the rotational plate 130, the second positioning portion 151*c* of the positioning component 151*b* and the first switch 140 are separated from each other.

Figure 9A:
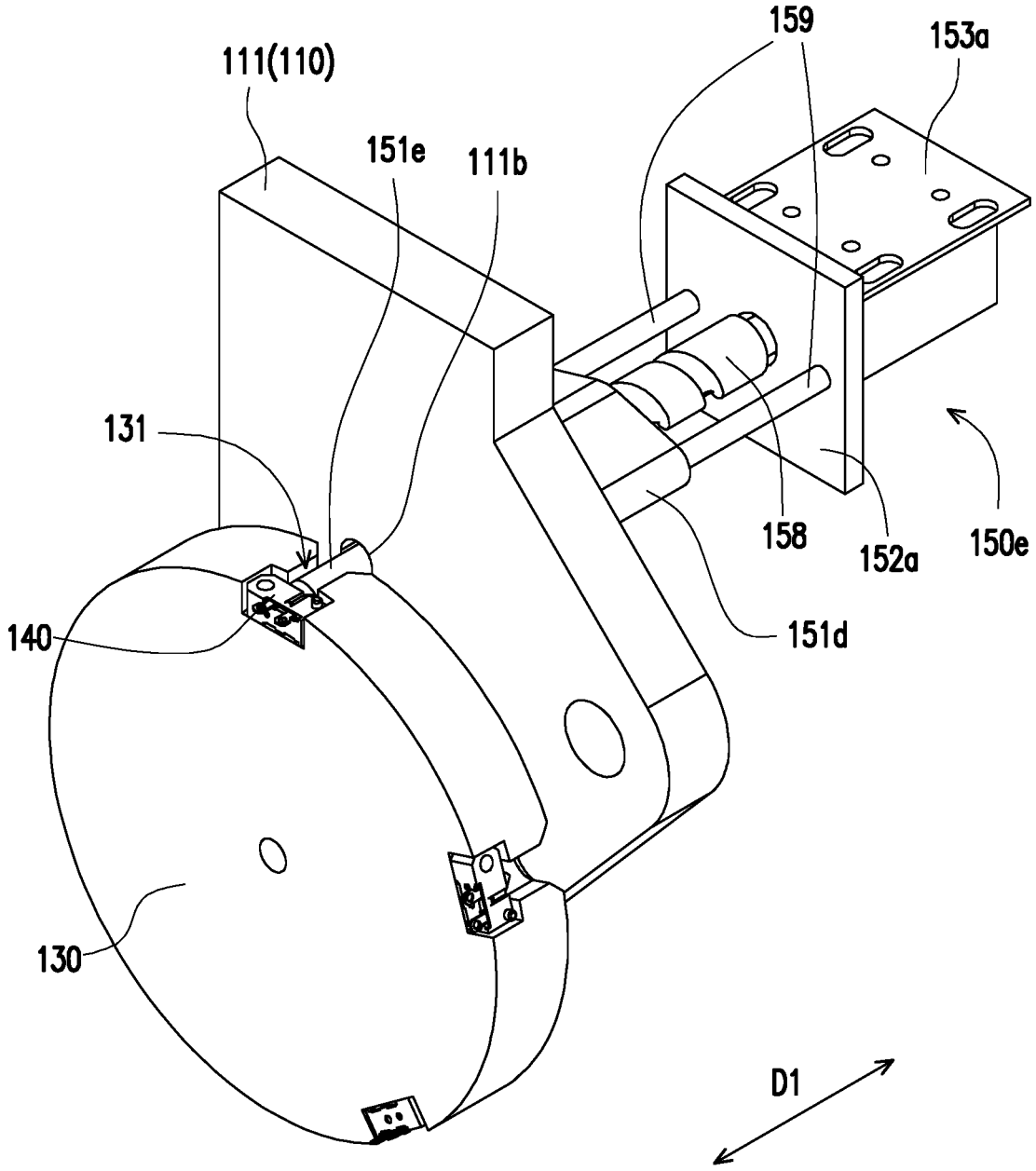
FIG. 9A and FIG. 9B are respective schematic structural views illustrating a positioning assembly in two actuating statuses according to a sixth embodiment of the disclosure.
Figure 9B:
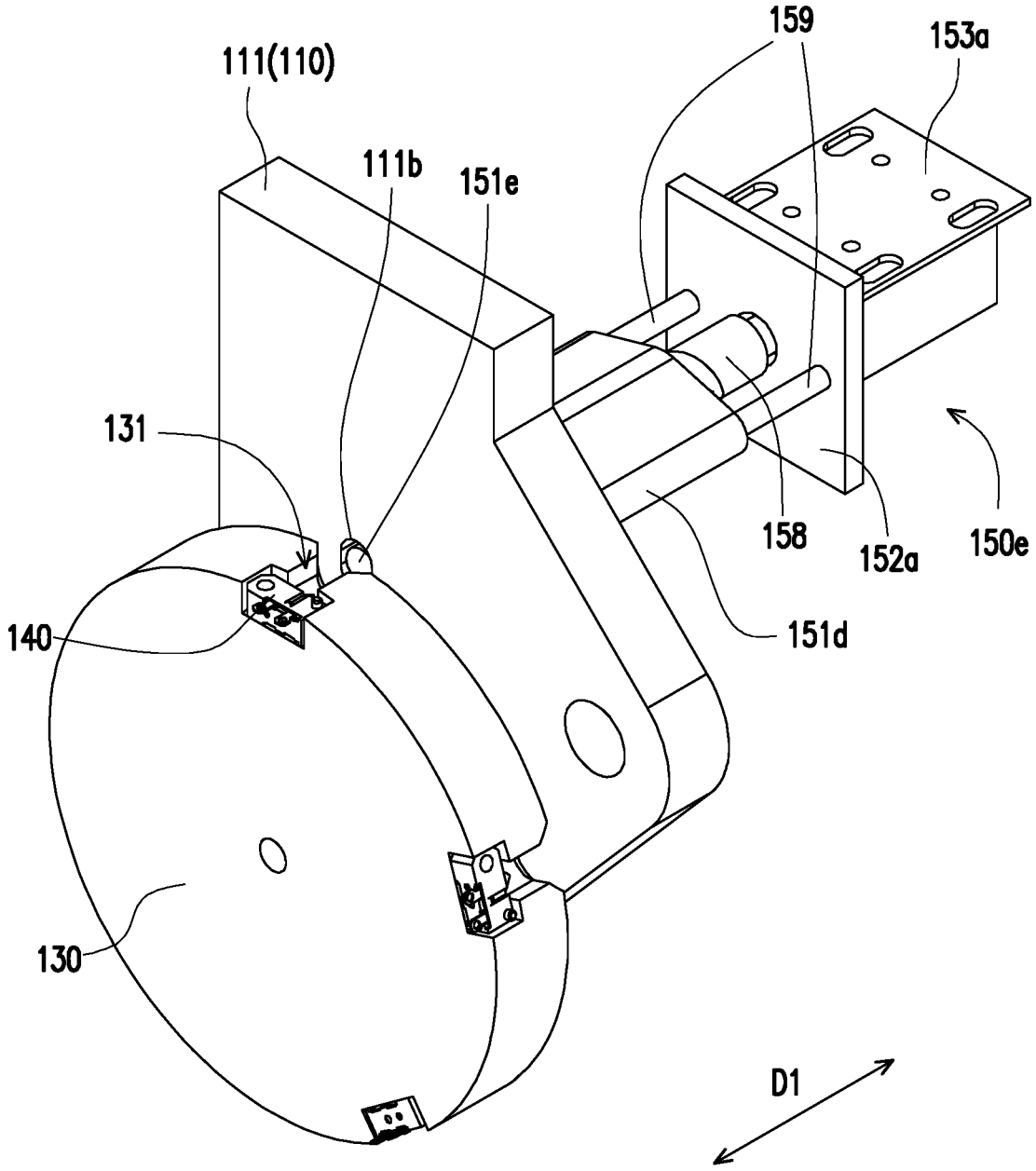

FIG. 9A and FIG. 9B are respective schematic structural views illustrating a positioning assembly in two actuating statuses according to a sixth embodiment of the disclosure. For ease of description, the first side wall portion 111 of a carriage 152*a*, the rotational plate 130 and the first switch 140 disposed at the first positioning portion 131 are illustrated for exemplary purpose. Referring to FIG. 9A and FIG. 9B, a positioning assembly 150*e* in the embodiment is adaptable for the rotational positioning mechanism 100 in the first embodiment, and the main difference between the positioning assembly 150*e* and the positioning assembly 150 in the first embodiment is that the driver of the positioning assembly 150*e* is a motor 153*a*, and the positioning assembly 150*e* further includes a first guiding component 158 and a second guiding component 159. The motor 153*a* is fixed to the carriage 152*a*, and the first guiding component 158 and the second guiding component 159 are disposed between the carriage 152*a* and the first side wall portion 111.

The first guiding component 158 may be a screw rod, wherein an output shaft of the motor 153*a* penetrates through the carriage 152*a* and is coupled to the first guiding component 158, and the first guiding component 158 is penetrates through a positioning component 151*d*. The second guiding component 159 may be a sliding rod disposed in pairs, wherein the second guiding component 159 is fixed to the carriage 152*a* and the first side wall portion 111 and penetrates through the positioning component 151*d*. The positioning component 151*d* is disposed as corresponding to the slot 111*b*, and a through hole (i.e., a through hole penetrated through by the first guiding component 158) of the positioning component 151*d* has a female thread in coordination with a male thread on the screw rod. Therefore, after the first guiding component 158 is driven by the motor 153*a*, the first guiding component 158 is rotated and drives the positioning component 151*d* to be guided by the second guiding component 159 to move back and forth relative to the first side wall portion 111 along the moving direction D1, such that a second positioning portion 151*e* of the positioning component 151*d* penetrates through the first side wall portion 111 from the slot 111*b* to form structural interference with the first positioning portion 131 (i.e., positioning recess) of the rotational plate 130, or such that the second positioning portion 151*e* of the positioning component 151*d* is moved back into the slot 111*b* to remove the structural interference.

After the second positioning portion 151*e* of the positioning component 151*d* form the structural interference with the first positioning portion 131 (i.e., positioning recess) of the rotational plate 130, the second positioning portion 151*e* of the positioning component 151*d* abuts against and triggers the first switch 140. On the contrary, after the second positioning portion 151*e* of the positioning component 151*d* is moved back into the slot 111*b* to remove the structural interference with the first positioning portion 131 (i.e., positioning recess) of the rotational plate 130, the second positioning portion 151*e* of the positioning component 151*d* and the first switch 140 are separated from each other.

In summary, the rotational plate in the rotational positioning mechanism of the disclosure can be automatically rotated relative to the base along with the rotational shaft. More specifically, before the rotational plate is rotated relative to the base along with the rotational shaft, it is required to remove the structural interference between the positioning component and one of the positioning portions of the rotational plate. In the meantime, by using the positioning component to activate the first triggering mechanism, the rotational plate is rotated relative to the base along with the rotational shaft. In this manner, it can be avoided that the rotational plate is forcefully rotated, which causes damage to the positioning component and the rotational plate that are structurally interfered with each other. After the next positioning portion of the rotational plate is rotated to a position and aligned with the positioning component, the positioning component and the next positioning portion of the rotational plate form structural interference automatically. Also, the first triggering mechanism is removed and the second triggering mechanism is activated via the positioning component to stop rotating the rotational shaft and the rotational plate. In this manner, it can be avoided that the positioning component and the rotational plate that are structurally interfered with each other are destroyed. After the status of the rotational plate is locked, even if the rotational plate is subjected to an external force, the rotational plate is not easily rotated relative to the base. Therefore, both of the rotational positioning mechanism and the carrier utilizing the rotational positioning mechanism in the disclosure can have good reliability.

Although the disclosure has been disclosed by the above embodiments, the embodiments are not intended to limit the disclosure. It will be apparent to those skilled in the art that various modifications and variations can be made to the structure of the disclosure without departing from the scope or spirit of the disclosure. Therefore, the protecting range of the disclosure falls in the appended claims.

What is claimed is:

1. A rotational positioning mechanism, comprising:

a base;

a rotational shaft, pivoted to the base;

a rotational plate, connected to the rotational shaft, and configured to rotate relative to the base along with the rotational shaft, the rotational plate has at least two first positioning portions;

at least two first switches, respectively disposed at the at least two first positioning portions; and a positioning assembly, disposed at the base, the positioning assembly comprising a positioning component, configured to form structural interference with any one of the first positioning portions or remove structural interference, after the positioning component form structural interference with any one of the first positioning portions, the positioning component abutting against the corresponding first switch, and a degree of rotational freedom of the rotational plate and the rotational shaft being restricted.

2. The rotational positioning mechanism according to claim 1, wherein the base comprises at least a side wall portion, and the side wall portion has an assembly hole and a slot disposed in parallel, the positioning assembly and the rotational plate are respectively disposed at two opposite sides of the side wall portion, wherein the rotational plate has an installing end portion penetrating through the side wall portion from the assembly hole for connecting the rotational plate, and the positioning component has a second positioning portion penetrating through the side wall portion from the slot, the second positioning portion is configured to form structural interference with any one of the first positioning portions or remove structural interference.

3. The rotational positioning mechanism according to claim 2, further comprising:

a second switch, disposed in the slot, when the second positioning portion is moved away from one of the first positioning portions to remove structural interference, the second positioning portion and the first switch disposed at one of the first positioning portions are separated from each other and triggers the second switch to activate the rotational shaft to drive the rotational plate to rotate relative to the base, when the rotational plate is rotated relative to the base such that another one of the first positioning portions is aligned with the second positioning portion, the second positioning portion is moved close to said another one of the first positioning portions to form structural interference, and the second positioning portion and the second switch are separated from each other and triggers the first switch disposed at said another one of the first positioning portions to stop the rotational shaft from driving the rotational plate to rotate relative to the base.

4. The rotational positioning mechanism according to claim 2, wherein the positioning assembly further comprises a carriage and a driver, the carriage is fixed to the side wall portion, and the driver is fixed to the carriage, the positioning component is pivoted to the carriage, and the driver is configured to drive the positioning component to rotate relative to the carriage, such that the second positioning portion is moved in the slot to form structural interference with any one of the first positioning portions or remove structural interference.

5. The rotational positioning mechanism according to claim 4, wherein the positioning assembly further comprises an elastic component, and two opposite end portions of the elastic component are respectively connected to the carriage and the positioning component, in a process that the second positioning portion is moved away from one of the first positioning portions to remove structural interference, the positioning component is driven by the driver to rotate relative to the carriage, such that the second positioning portion is moved away from one of the first positioning portions and the elastic component is elastically deformed, after the rotational plate is rotated relative to the base such that another one of the first positioning portions is aligned with the second positioning portion, an elastic restoring force of the elastic component drives the positioning component to rotate relative to the carriage such that the second positioning portion is moved close to said another one of the first positioning portions to form structural interference.

6. The rotational positioning mechanism according to claim 4, wherein the positioning assembly further comprises a driving component coupled to the driver, the driving component is configured to be driven by the driver to push the positioning component to rotate relative to the carriage or separate from the positioning component.

7. The rotational positioning mechanism according to claim 6, further comprising:

a side switch, disposed at the side wall portion, the rotational plate has at least a triggering portion facing the side wall portion and disposed as corresponding to the side switch, in a process that the rotational plate is rotated relative to the base such that any one of the first positioning portions is aligned with the second positioning portion, the at least one triggering portion triggers the side switch to activate the driver to drive the driving component to rotate relative to the carriage to be separated from the positioning component.

8. The rotational positioning mechanism according to claim 4, wherein the driver is an electromagnetic valve, and the positioning assembly further comprises a driving component, the driving component is coupled to the electromagnetic valve, and the driving component is connected to the positioning component, the driving component is configured to be driven by the electromagnetic valve to move back and forth, thereby driving the positioning component to rotate relative to the carriage.

9. The rotational positioning mechanism according to claim 4, wherein the driver is a motor.

10. The rotational positioning mechanism according to claim 2, wherein the positioning assembly further comprises a driver, and the positioning component is coupled to the driver, the driver is configured to drive the positioning component to move back and forth relative to the side wall portion, such that the second positioning portion penetrates through the side wall portion from the slot to form structural interference with any one of the first positioning portions, or such that the second positioning portion is moved back into the slot to remove structural interference with any one of the first positioning portions.

11. The rotational positioning mechanism according to claim 10, wherein the driver is an electromagnetic valve.

12. The rotational positioning mechanism according to claim 10, wherein the driver is a motor, the positioning assembly further comprises a carriage, a first guiding component and a second guiding component, and the first guiding component and the second guiding component are disposed between the carriage and the side wall portion, the motor is fixed to the carriage, the first guiding component is coupled to the motor and sleeved on the positioning component, the second guiding component is fixed to the carriage and sleeved on the positioning component, the first guiding component is configured to be driven by the motor to rotate and drive the positioning component to be guided by the second guiding component to move back and forth.

13. A carrier, comprising:

a driven component; and a rotational positioning mechanism, comprising:

a base;

a rotational shaft, pivoted to the base;

a rotational plate, connected to the rotational shaft, and configured to rotate relative to the base along with the rotational shaft, the rotational plate has at least two positioning portions, the driven component being connected to the rotational plate and configured to rotate relative to the base along with the rotational plate and the rotational shaft;

at least two switches, respectively disposed at the at least two positioning portions; and a positioning assembly, disposed at the base, the positioning assembly comprising a positioning component configured to form structural interference with any one of the positioning portions or remove structural interference, after the positioning component forms structural interference with any one of the positioning portions, the positioning component abuts against the corresponding switch, and a degree of rotating freedom of the rotational plate and the rotational shaft being restricted.

14. The carrier according to claim 13, wherein the base comprises at least a side wall portion, and the side wall portion has an assembly hole and a slot disposed in parallel, the positioning assembly and the rotational plate are respectively disposed at two opposite sides of the side wall portion, wherein the rotational plate has an installing end portion penetrating through the side wall portion from the assembly hole for connecting the rotational plate, and the positioning component has a second positioning portion penetrating through the side wall portion from the slot, the second positioning portion is configured to form structural interference with any one of the first positioning portions or remove structural interference.

15. The carrier according to claim 14, wherein the rotational positioning mechanism further comprising:

a second switch, disposed in the slot, when the second positioning portion is moved away from one of the first positioning portions to remove structural interference, the second positioning portion and the first switch disposed at one of the first positioning portions are separated from each other and triggers the second switch to activate the rotational shaft to drive the rotational plate to rotate relative to the base, when the rotational plate is rotated relative to the base such that another one of the first positioning portions is aligned with the second positioning portion, the second positioning portion is moved close to said another one of the first positioning portions to form structural interference, and the second positioning portion and the second switch are separated from each other and triggers the first switch disposed at said another one of the first positioning portions to stop the rotational shaft from driving the rotational plate to rotate relative to the base.

16. The carrier according to claim 14, wherein positioning assembly further comprises a carriage and a driver, the carriage is fixed to the side wall portion, and the driver is fixed to the carriage, the positioning component is pivoted to the carriage, and the driver is configured to drive the positioning component to rotate relative to the carriage, such that the second positioning portion is moved in the slot to form structural interference with any one of the first positioning portions or remove structural interference.

17. The carrier according to claim 16, wherein the positioning assembly further comprises an elastic component, and two opposite end portions of the elastic component are respectively connected to the carriage and the positioning component, in a process that the second positioning portion is moved away from one of the first positioning portions to remove structural interference, the positioning component is driven by the driver to rotate relative to the carriage, such that the second positioning portion is moved away from one of the first positioning portions and the elastic component is elastically deformed, after the rotational plate is rotated relative to the base such that another one of the first positioning portions is aligned with the second positioning portion, an elastic restoring force of the elastic component drives the positioning component to rotate relative to the carriage such that the second positioning portion is moved close to said another one of the first positioning portions to form structural interference.

18. The carrier according to claim 16, wherein the positioning assembly further comprises a driving component coupled to the driver, the driving component is configured to be driven by the driver to push the positioning component to rotate relative to the carriage or separate from the positioning component.

19. The carrier according to claim 18, wherein the rotational positioning mechanism further comprising:

a side switch, disposed at the side wall portion, the rotational plate has at least a triggering portion facing the side wall portion and disposed as corresponding to the side switch, in a process that the rotational plate is rotated relative to the base such that any one of the first positioning portions is aligned with the second positioning portion, the at least one triggering portion triggers the side switch to activate the driver to drive the driving component to rotate relative to the carriage to be separated from the positioning component.

20. The carrier according to claim 16, wherein the driver is an electromagnetic valve, and the positioning assembly further comprises a driving component, the driving component is coupled to the electromagnetic valve, and the driving component is connected to the positioning component, the driving component is configured to be driven by the electromagnetic valve to move back and forth, thereby driving the positioning component to rotate relative to the carriage.

21. The carrier according to claim 16, wherein the driver is a motor.

22. The carrier according to claim 14, wherein the positioning assembly further comprises a driver, and the positioning component is coupled to the driver, the driver is configured to drive the positioning component to move back and forth relative to the side wall portion, such that the second positioning portion penetrates through the side wall portion from the slot to form structural interference with any one of the first positioning portions, or such that the second positioning portion is moved back into the slot to remove structural interference with any one of the first positioning portions.

23. The carrier according to claim 22, wherein the driver is an electromagnetic valve.

24. The carrier according to claim 22, wherein the driver is a motor, the positioning assembly further comprises a carriage, a first guiding component and a second guiding component, and the first guiding component and the second guiding component are disposed between the carriage and the side wall portion, the motor is fixed to the carriage, the first guiding component is coupled to the motor and sleeved on the positioning component, the second guiding component is fixed to the carriage and sleeved on the positioning component, the first guiding component is configured to be driven by the motor to rotate and drive the positioning component to be guided by the second guiding component to move back and forth.

* * * * *